United States Patent [19]

Tax et al.

[11] 4,047,617

[45] Sept. 13, 1977

[54] LUFFING CRANE WITH OVERLOAD PROTECTION MECHANISM

[75] Inventors: Hans Tax, Munich; Klaus Hösler, Eichenau, both of Germany

[73] Assignee: Hans Tax, Munich, Germany

[21] Appl. No.: 726,988

[22] Filed: Sept. 27, 1976

Related U.S. Application Data

[63] Continuation of Ser. No. 635,244, Nov. 25, 1975, abandoned.

[30] Foreign Application Priority Data

Nov. 28, 1974 Germany ..... 2456359

[51] Int. Cl.[2] ..... B66C 13/48

[52] U.S. Cl. ..... 212/39 MS; 340/267 C; 212/58 R

[58] Field of Search ..... 212/2, 39 R, 39 B, 39 DB, 212/39 MS, 39 A, 58 R; 340/267 C

[56] References Cited

U.S. PATENT DOCUMENTS

| | | | |
|---|---|---|---|
| 2,022,844 | 12/1935 | Christian | 212/2 |
| 2,030,529 | 2/1936 | Nash | 212/39 MS |
| 3,680,714 | 8/1972 | Holmes | 212/39 A |
| 3,724,679 | 4/1973 | Brownell et al. | 212/39 MS |
| 3,740,534 | 6/1973 | Kezer et al. | 212/39 A X |

FOREIGN PATENT DOCUMENTS

| | | |
|---|---|---|
| 1,953,073 | 8/1972 | Germany |
| 1,105,581 | 4/1961 | Germany |

*Primary Examiner*—Albert J. Makay
*Assistant Examiner*—R. B. Johnson
*Attorney, Agent, or Firm*—Hans Berman

[57] ABSTRACT

The winches of a luffing crane having two individually operated hoisting cables depending from different longitudinal sections of the boom are deenergized by an overload protection mechanism when the torque exerted during luffing by a single load suspended from both cables exceeds a value consistent with the stability of the crane. The mechanism which employs only mechanical elements derives signals from the stresses transmitted by the loaded cables to the two winches, weights the signals in accordance with the different spacing of the dependent cable ends, adds the weighted signals, and compares the sum so obtained with a signal derived from the angular boom position and a curve of maximum permissible loads arrived at from design parameters of the crane and the spacing of the cable ends.

8 Claims, 5 Drawing Figures

LUFFING CRANE WITH OVERLOAD PROTECTION MECHANISM

CROSS-REFERENCE TO RELATED APPLICATION

Figure 1:
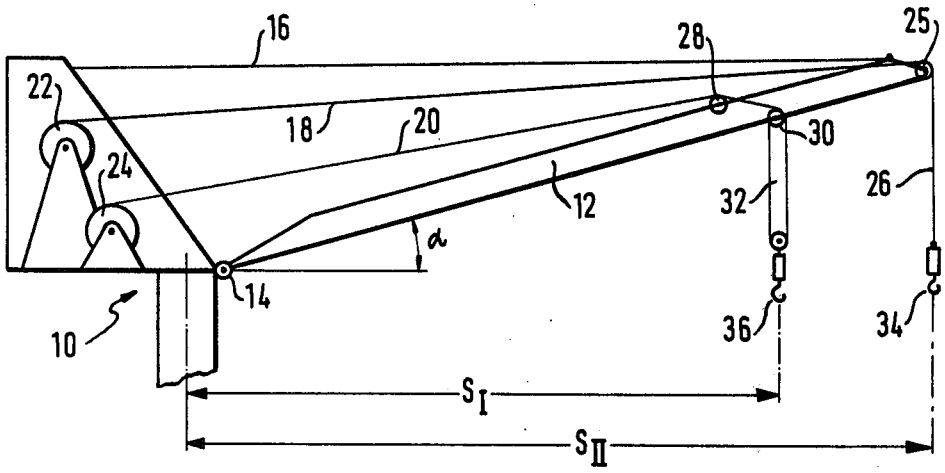

This is a continuation of application Ser. No. 635244, filed Nov. 25, 1975, now abandoned.

BRIEF SUMMARY OF THE INVENTION

This invention relates to luffing cranes, and particularly an overload protection mechanism for a luffing crane.

A luffing crane has a boom pivotally fastened to the base of the crane for movement about an approximately horizontal axis so that a load suspended from the boom by a hoisting cable may be moved radially toward and away from the crane base by pivoting the boom. Overloads are readily prevented by conventional mechanisms automatically controlled by the stress in the hoisting cable and the angular position of the boom. Known Luffing cranes having two independently operated hoisting cables which depend from the boom at different distances from the pivot are normally provided with individual overload protection devices associated with the two cables and the corresponding winches.

The known mechanical overload protection devices are not suited to protect the crane against excessive torque exerted by a single load simultaneously suspended from both hoisting cables, and the crane operator's judgement is decisive in preventing toppling of the crane under an excessive load of this type. A computer may be programmed to stop one or both winches if data indicative of individual cable stresses, spacings of depending cable ends from the boom pivot, and of mechanical, particularly static characteristics of the crane structure are supplied as inputs, but complex electronic devices are not always reliable under the rough operating condition prevailing on a crane.

It is a primary object of this invention to provide an overload protection mechanism for a luffing crane equipped with two hoisting cables depending from different longitudinal sections of its boom which consists entirely of mechanical elements, yet is capable of protecting the crane against overloading by a single load simultaneously suspended from both hoisting cables.

With this object and others in view, as will hereinafter become apparent, the invention provides a luffing crane of the type described with an overload protection mechanism which includes a signal generating device generating a mechanical stress signal in response to the stress transmitted to each of the two winches by the associated cable or other tension member due to a load suspended from the same. Each of the two signals is weighted in accordance with the spacing of the corresponding, depending cable end portion from the boom pivot. A mechanical signal then is generated by an adding device, and is indicative of the sum of the weighted signals. A display device connected to the boom for simultaneous movement displays a mechanical signal indicative of the angular position of the boom relative to the crane base, and further indicative of the maximum permissible value of the sum of weighted stress signals in the indicated angular position, such a permissible value being readily calculated from the known structural and dimensional features of the crane. A mechanical comparator responds to the adding device and the display device to compare the maximum permissible value with the sum of the weighted stress signals and deenergizes one of the crane winches in response to an excess of the indicated sum over the maximum permissible value.

Figure 2:
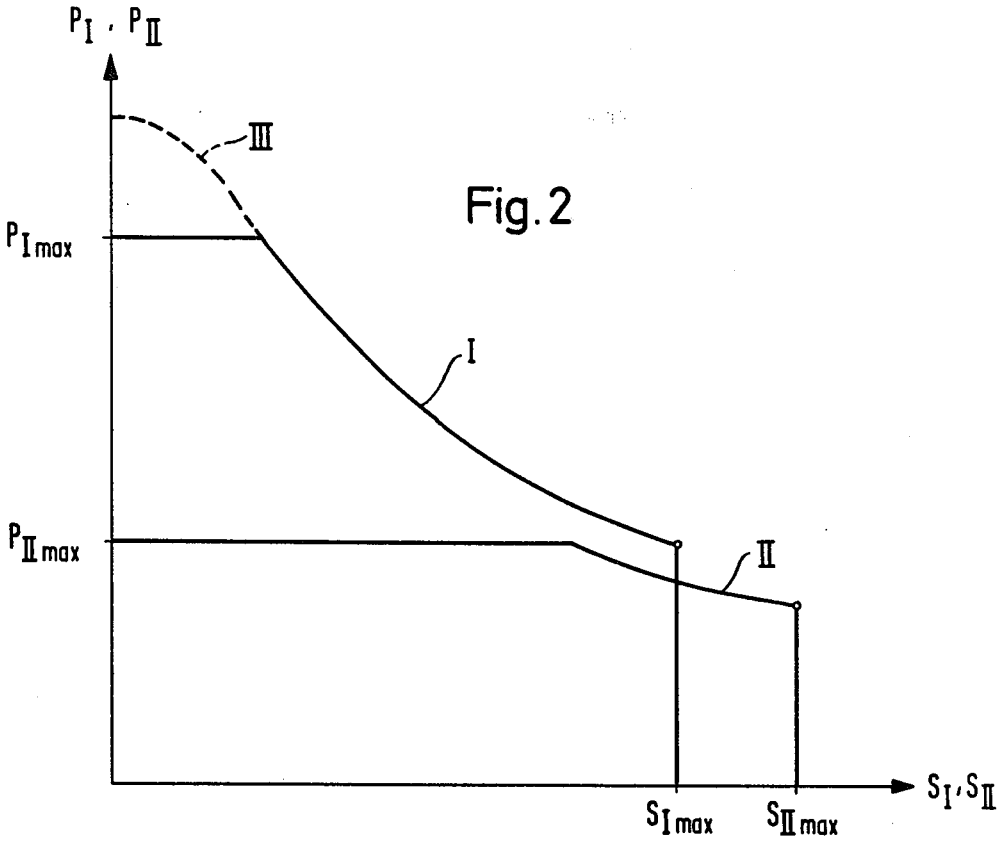
Figure 3:
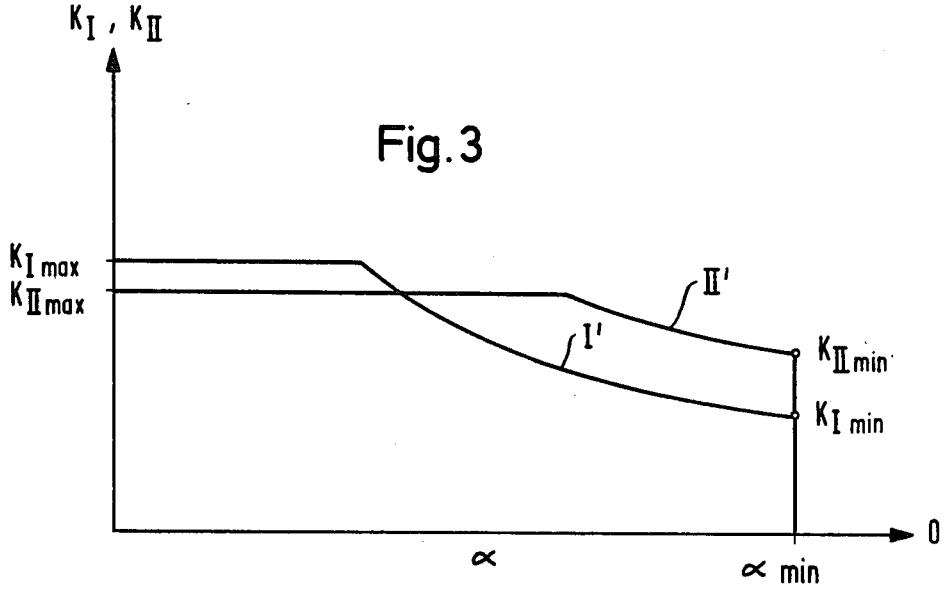
Figure 4:
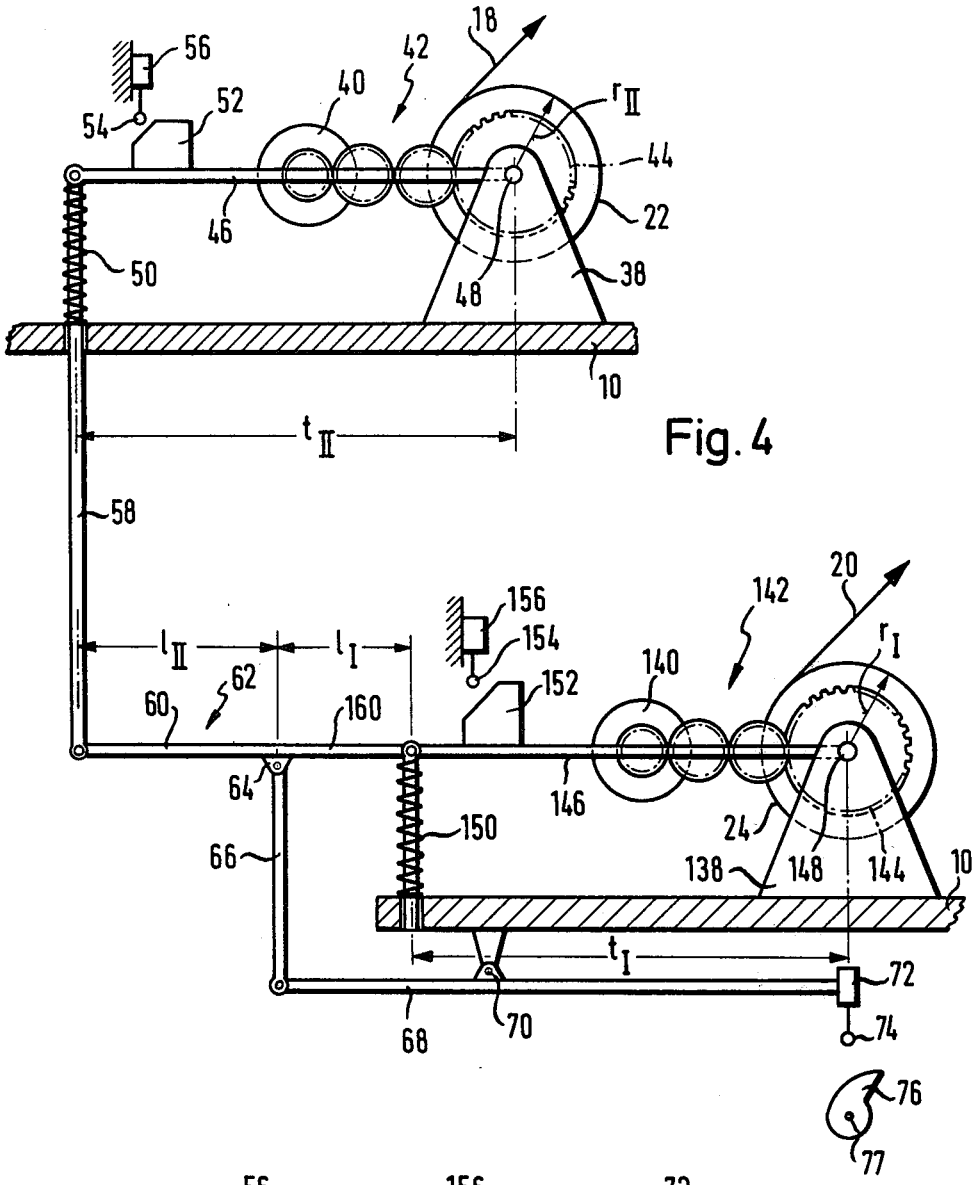
Figure 5:
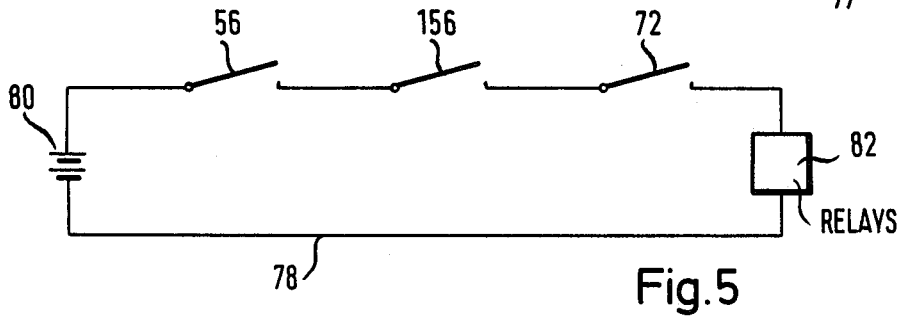

Other features, additional objects, and many of the attendant advantages of this invention will readily become apparent from the following detailed description of a preferred embodiment when considered in connection with the appended drawing in which:

FIG. 1 is a simplified elevational view of an otherwise conventional luffing crane equipped with the overload protection system of the invention;

FIG. 2 graphically illustrates the highest permissible load that may be suspended from each of the two hoisting cables of the crane of FIG. 1 as a function of the horizontal distance of the load from the vertical axis of crane rotation when the other cable is idle;

FIG. 3 graphically illustrates the relationship of the highest permissible stress exerted by the hoisting cables on the associated cable drums as a function of the angle of inclination of the crane boom;

FIG. 4 illustrates the overload protection system of the invention in the crane of FIG. 1 in fragmentary elevation; and FIG. 5 shows basic features of the electrical circuit of the apparatus of FIG. 4.

Referring first to FIG. 1, there is seen a luffing crane whose base 10 may turn about its vertical axis. One end of a boom 12 is secured to the base 10 by a pivot 14 whose axis is horizontal. The angle $\alpha$ between the longitudinal axis of the boom 12 and the horizontal may be varied by means of a luffing cable 16 connecting the free end of the boom 12 to a winch on the base 10 in a conventional manner, not shown, whereby a load suspended from the boom may be moved horizontally toward and away from the base 10.

Respective ends of hoisting cables 18, 20 are wound on cable drums 22, 24 of respective winches. The cable 18 is trained over a pulley 25 at the free end of the boom 12, and the depending end portion 26 of the cable 18 carries a load hook 34. The hoisting cable 20 is trained over two pulleys 28, 30 arranged on the upper and lower chord of the boom 12 respectively and spaced toward the pivot 14 from the pulley 25. The depending end 32 of the cable 20 carries a load hook 36. The torque exerted by the same load attached to the hooks 34 or 36 on the crane base 10 is proportional to the horizontal spacing $S_{II}$ or $S_I$ of the hooks and the depending cable ends 26, 32 from the vertical axis of base rotation. This basis of further calculations is generally preferred in this art and does not introduce a significant error because the horizontal distance between the vertical base axis and the pivot 14 is normally negligible.

In FIG. 2, curve II represents the greatest useful load $P_{II}$ that may be suspended from the cable end 26 as a function of the spacing $S_{II}$ which varies with varying angle $\alpha$. Curve I similarly represents the highest permissible load $P_I$ that may be suspended from the cable end 32 as a function of the spacing $S_I$. The two curves indicate maximum permissible loads on either hoisting cable if there is no load on the other cable and may be calculated for any given crane in a known manner mainly on the basis of the requirement that a load suspended from one of the cables must not produce more than a fixed torque during luffing movement of the boom in order not to impair the stability of the crane.

With decreasing values of $S_I$, $S_{II}$, a point is reached on each curve I, II when the permissible load no longer is limited by the stability of the crane, but by the tensile strength of the hoisting cable which is independent from $S_I$, $S_{II}$ and defines the absolute load limits $P_{Imax}$ and $P_{IImax}$ for the cable ends 32, 26. $S_I$ and $S_{II}$ reach maximum values $S_{Imax}$ and $S_{IImax}$ respectively when the boom 12 reaches its lowermost, almost horizontal position in which $\alpha$ approaches zero.

FIG. 3 shows the changes in the stresses $K_I$, $K_{II}$ in the hoisting cables 20, 18 as a function of the boom angle $\alpha$ as determined by the curves I and II in FIG. 2. However, the stresses in the hoisting cables may be different from the force of gravity acting on a hoisted load because the depending cable ends 26, 32 may be reeved differently. In the illustrated example, the end 32 of the cable 20 is reeved through a block on the hook 36 and attached to the boom 12, whereas the hoisting cable 18 is fastened directly to the hook 34.

The line I' in FIG. 3 indicates the highest possible stress in the cable 20 permitted under conditions of FIG. 2, while the line II' indicates the highest stress value in the hoisting cable 18. Because of the limitations due to stability requirements, as discussed with reference to FIG. 2, the highest possible stresses in both cables reach minimum values $K_{Imin}$, $K_{IImin}$ at the smallest available angle $\alpha_{min}$ of boom inclination which is 15° in the crane illustrated in FIG. 1.

FIG. 4 shows elements of the crane of FIG. 1 on a larger scale together with the overload protection arrangement of the invention.

The cable drum 22 has an effective radius $r_{II}$ and is mounted on the base 10 by means of a pedestal 38. The drum 22 is turned by an electric motor 40 through reduction gearing 42 whose output member meshes with a gear 44 coaxially attached to the drum 22. The motor 40 and the reduction gearing 42 are supported on a carrier 46 one end of which is hinged to the shaft 48 of the drum 22 while the other end is attached to a helical tension spring 50. The carrier 46 has a length $t_{II}$. The lifting force in the cable 18 exerts a moment of reaction on the carrier 46 by way of the gearing 42 which ultimately is absorbed by the spring 50. The spring 50, the carrier 46 and associated elements thus jointly constitute means for absorbing the moment of reaction to the lifting force. When the carrier pivots clockwise from the illustrated position through a sufficient angle, a cam 52 on the carrier 46 engages the actuating element 54 on a switch 56 fixedly mounted on the base 10 and opens the switch.

The cable drum 24 of radius $r_I$ is similarly mounted on the base 10 by means of a pedestal 138, and is driven by an electric motor 140 through reduction gearing 142 which meshes with a coaxial gear 144 on the drum 20. The motor 140 and gearing 142 are mounted on a carrier 146 having a length $t_I$ between its hinged support on the shaft 148 of the drum 24 and a helical tension spring 150, the spring 150, carrier 146, and associated elements absorbing the moment of reaction to the lifting force in the cable 20. A cam 152 on the carrier 146 may open a switch 156 by engagement with its actuating element 154.

The end of the carrier 46 adjacent the spring 50 is coupled to one arm 60 of length $1_{II}$ of a lever 62 by a hinged bar 58. The other arm 160 of the lever 62 has a length $1_I$ and is coupled directly to the carrier 146. The movable fulcrum 64 of the lever 62 is supported on one end of a rod 66 whose other end is hinged to one arm of a lever 68 fulcrumed on a pivot 70 which is fixed on the base 10. The other arm of the lever 68 carries a switch 72 having an actuating element 74 which faces a radial cam 76. The cam is coupled to the boom 12 for joint angular movement by its shaft 77 and other elements of a conventional motion transmitting train, not shown.

The cam 76 is shaped in such a manner that the switch 72 is opened under the conditions of curves I or I' when only the cable 20 carries a load. As will presently be shown, the cam 76 is also effective to open the switch 72 under the conditions represented by curves II or II' when only the cable 18 is loaded.

It has been found that the ratio of the values $K_{Imin}$ and $K_{IImin}$, which are inherent properties of the conventional crane elements, may be used for determining the weighting coefficients to be applied to the actual load stresses in the cables 18, 20. The "combined load value" arrived at as the sum of the weighted, actual stresses may cause operation of the switch 72 when the load on one of the dependent cable ends 26, 32 or the combined load exceeds a limit permissible at the prevailing inclination of the boom 12.

The ratio of the lengths $l_I$ and $l_{II}$ of the lever arms 60, 160 according to the invention is made equal to the ratio of the values $K_{Imin}$, $K_{IImin}$ in FIG. 3 if the radii $r_I$, $r_{II}$ of the cable drums 22, 24, the lengths $t_I$, $t_{II}$ of the carriers 46, 146, and the characteristics of the springs 50, 150 are equal. If $r_I$ and $r_{II}$, $t_I$ and $t_{II}$ are not equal, the lengths $l_I$, $l_{II}$ must satisfy the following relationship:

$$(l_I/l_{II}) = K_{Imin}/K_{IImin} \times t_{II}/t_I \times r_I/r_{II}$$

Under these conditions, the same cam 76 causes opening of the switch 72 at the hoisting cable load $K_{Imin}$ of the cable 20 as well as at the hoisting cable load $K_{IImin}$ of the cable 18 if the shape of the cam is derived from the arcuate portion of either line I, I' in FIG. 3.

When both cables 18, 20 are loaded simultaneously, the deflection of the lever 68 is proportional to the sum of the hoisting cable forces weighted or modified according to the above relationship. The switch 72 is operated at a value of the sum of the actual loads which is intermediate, at the prevailing boom inclination, between the highest permissible load on the cable 20 (upper limit) and the highest permissible load on the cable 18 (lower limit).

The following procedure may be chosen for setting the overload protection system:

At the smallest available angle $\alpha_{min}$ of boom inclination, the cable 18 is left free of a load, and the cable 20 is loaded to the stress $K_{Imin}$. The position of the switch 72 is then adjusted on the lever 68 so that the switch is about to be opened by the cam 76. If other parameters were properly selected in accordance with the above formula, the switch 72 should also be opened by the cam 76 if the cable 18 is loaded to the stress $K_{IImin}$ in the absence of a load on the cable 20. If this is not the case, a minor change in the tension of the spring 50 brings about the desired condition.

The switches 56, 156 are adjusted in the same manner relative to the cams 52, 152 independently of each other by loading the cables 18, 20 individually at $P_{IImax}$ and $P_{Imax}$ respectively at zero load on the other cable.

When operating at short radial range or at great angles $\alpha$ of boom inclination, the highest permissible load is primarily determined by the tensile strength of the cables and not by the moment created by the load. It is then possible, by means of both cable drums, to lift a single load heavier than $P_{Imax}$ by distributing the load in such a manner on the two cables 18, 20 that the share assigned to each cable is smaller than its capacity $P_{Imax}$ or $P_{IImax}$. The overload protection mechanism of the invention permits such a mode of operation to be monitored without additional devices and solely by suitable shape of the radial cam 76.

The cam 76 is shaped to define a limiting, switch actuating curve for the highest joint load of the depending cable ends 26, 32 which is still permissible for static reasons. This limiting curve is indicated in FIG. 2 by the broken line III. If a terminal face portion of the cam 76 is shaped in a corresponding manner, the limits set by the static conditions and the stability of the crane cannot be exceeded by a single load which is heavier than $P_{Imax}$ and suspended from both depending cable ends 26, 32. If the load is not properly distributed between the two cables so as to exceed $P_{IImax}$ for cable 18 or $P_{Imax}$ for cable 20, one of the switches 56, 156 is opened.

As is shown in FIG. 5, the several switches 56, 72, 156 are arranged in a series circuit 78 with a current source 80 and the energizing relay 82 of the motors 40, 140 so as to stop both motors and the associated cable drums if any one of the switches is opened. The relays may simultaneously control the drive motor of the non-illustrated winch for the luffing cable 16 and the motor, not shown, which turns the crane about the vertical axis of the base 10, and these additional motors may also be deenergized in the event of an overload if so desired.

The simple and rugged elements which constitute the overload protection mechanism of the invention constitute the mechanical equivalents of an electronic computer circuit. The reduction gearings 42, 142, carriers 46, 146, and springs 50, 150 absorb the moments of reaction to the stresses transmitted to the winches 22, 24 by the associated cables 18, 20, and generate mechanical stress signals which are transmitted to the two lever arms 60, 160 either by the coupling bar 58 or directly. The stress signals are weighted by the different lengths of the lever arms 60, 160 in accordance with the different spacing of the depending cable portions 26, 32 from the pivot 14 or from the vertical axis of the base 10, and are added by the lever so that the position of the fulcrum 64 constitutes a mechanical signal indicative of the sum of the weighted signals.

The cam 76 displays a mechanical signal indicative of the angular position of the boom 12 relative to the base 10 by its own angular position, and the portion of its arcuate cam face radially aligned with the switch actuating member 74 displays a mechanical signal indicative of the maximum permissible value of the weighted signal sum indicated by the position of the fulcrum 64. The switch 72 connected to the fulcrum 64 by the lever 68 and the connecting rod 66 constitutes a comparator which responds to the display of the cam 76 for deenergizing a winch drive when the sum of weighted stress signals transmitted from the fulcrum 64 by the rod 66 and lever 68 exceeds the maximum permissible value displayed by the cam 76.

While cables 16, 18, 20 have been referred to throughout this specification, and are normally preferred, other elongated flexible tension members, such as ropes or chains, may be substituted without affecting the overload protection mechanism of this invention. Other substitutions of equivalents will readily suggest themselves to those skilled in the art who may also transpose the switch 72, its activating member 74, and the cam 76 in such a manner that the switch is interposed between the cam 76 and its shaft 77, and the member 74 being mounted on the lever 68 to engage the cam 76 which in turn opens the switch, the cam and switch turning on the shaft 77.

It should be understood, therefore, that the foregoing disclosure relates only to a preferred embodiment of the invention, and that it is intended to cover all changes and modifications of the example of the invention herein chosen for the purpose of the disclosure which do not constitute departes from the spirit and scope of the invention set forth in the appended claims.

What is claimed is:

1. A crane comprising:

a. a base;

b. an elongated boom;

c. a pivot securing one end of said boom to said base for angular luffing movement of said boom about a substantially horizontal axis;

d. two power-driven winches on said base;

e. two elongated flexible tension members respectively associated with said winches, 1. each tension member having one end portion attached to the associated winch, an intermediate portion trained over a longitudinal section of said boom spaced from said pivot, and another end portion depending from said section, 2. the spacing of said pivot from one of said sections and the end portion depending therefrom being different from the spacing of said pivot from the other section and depending end portion;

f. suspending means on each of said depending end portions for suspending respective loads from said tension members;

g. signal generating means for generating a mechanical stress signal in response to the stress transmitted to each winch by the associated tension member due to a suspended load;

h. weighting means for mechanically weighting each of said signals according to said spacing of the corresponding depending end portion from said pivot;

i. adding means for generating a mechanical signal indicative of the sum of the weighted signals;

j. display means connected to said boom for simultaneous movement for displaying a mechanical signal indicative of the angular position of said boom relative to said base and of a maximum permissible value of said sum in the indicated angular position; and k. comparator means responsive to said adding means and to said display means for comparing said maximum permissible value with the sum indicated by said adding means and responsive to an excess of the indicated sum over said maximum permissible value for deenergizing at least one of said winches.

2. A crane as set forth in claim 1, wherein said comparator means and said display means include an electric switch element and a switch operating element, one of said elements being connected to said boom for simultaneous movement, and the other element being connected to said adding means for movement thereby relative to said one element, for operating engagement of said elements, said winches being driven by electric power, and said switch element being arranged in the energizing circuit of one of said winches.

3. A crane as set forth in claim 2, wherein said adding and said weighting means include a two-armed lever and a movable fulcrum pivotally engaging said lever, the arms of said lever being connected to said signal generating means respectively, movement of said fulcrum under the mechanical signals generated by said signal generating means constituting said signal indicative of said sum.

4. A crane as set forth in claim 3, further comprising another two-armed lever pivotally mounted on said base, one arm of said other lever being coupled to said fulcrum for joint movement, the other arm of said lever carrying said other element.

5. A crane as set forth in claim 4, wherein said one element is a radial cam.

6. A crane as set forth in claim 1, wherein at least one of said signal generating means includes means for absorbing the moment of reaction to the stress transmitted to the associated winch by one of said tension members.

7. A crane as set forth in claim 1, further comprising switch means for deenergizing one of said winches in response to a stress transmitted to said one winch by the associated tension member when the transmitted stress exceeds a predetermined limit.

8. A crane as set forth in claim 7, wherein the signal generating means associated with said one winch include means for absorbing the moment of reaction to the stress transmitted to said one winch by the associated tension member, said switch means responding to the signal generated by said signal generating means.

* * * * *